US005738265A

United States Patent [19]

Hirai et al.

[11] Patent Number: 5,738,265

[45] Date of Patent: Apr. 14, 1998

[54] FASTENER GUN AND FASTENER ASSEMBLY FOR TAG HANGING

[75] Inventors: Tomoyuki Hirai; Shoichi Fukami, both of Tokyo, Japan

[73] Assignees: J.E. Co., Ltd., Tokyo, Japan; Ben Clements & Sons, Inc., Hackensack, N.J.

[21] Appl. No.: 649,373

[22] Filed: May 17, 1996

[51] Int. Cl.[6] ..... B25B 25/00

[52] U.S. Cl. ..... 227/67; 227/18; 227/144; 29/811.2; 29/235

[58] Field of Search ..... 227/18, 67, 118, 227/119, 120, 141, 144; 29/235, 241, 244, 267, 268, 432, 433, 450, 453, 811.2

[56] References Cited

U.S. PATENT DOCUMENTS

| | | | |
|---|---|---|---|
| 3,888,402 | 6/1975 | Bone | 227/67 |
| 4,240,183 | 12/1980 | Sumimoto et al. | 24/16 PB |
| 4,448,194 | 5/1984 | DiGiovanni et al. | 227/67 |
| 4,483,066 | 11/1984 | Akira | 227/18 |
| 4,516,577 | 5/1985 | Scott et al. | 227/144 |
| 4,536,933 | 8/1985 | Furutsu | 227/144 |
| 4,683,635 | 8/1987 | Duchin | 227/67 |
| 5,320,269 | 6/1994 | Deschenes et al. | 227/67 |
| 5,497,930 | 3/1996 | Kubota | 227/67 |
| 5,501,002 | 3/1996 | Fukami | 227/18 |

*Primary Examiner*—Jack W. Lavinder
*Assistant Examiner*—Jay A. Stelacone
*Attorney, Agent, or Firm*—Stroock & Stroock & Lavan LLP

[57] ABSTRACT

A loop pin attaching device for tag hanging is provided with a drive lever which is selectively moveable between a first, unactivated and a second, activated position. A link is rotatably connected with the drive lever and a piston member is connected to the other end of the link, the piston member and link being selectively moveable between first, unactivated and second, activated positions. A pressing body formed with a pipe shape is fixed to a front face of the piston. An insertion guide is dimensioned to allow the pressing body to slide therethrough when the piston member is moved and to receive an insertion portion of a loop pin. A rack gear is rotatably fixed to the link adjacent the second end of the link, and a gear group, formed of at least a first, smaller diameter gear and a second, larger diameter gear, is provided, the smaller diameter gear meshingly engaging the rack gear. A belt which engagingly meshes with the larger diameter gear is adapted to move a receiving portion of a loop pin, and a reception guide is dimensioned to guide this receiving portion when the guide lever is moved from a first position to a second position, wherein the insertion guide and the receiving guide are adapted to deliver an insertion portion and a receiving portion, respectively, of a loop pin to a common location to form a loop.

15 Claims, 18 Drawing Sheets

FASTENER GUN AND FASTENER ASSEMBLY FOR TAG HANGING

BACKGROUND OF THE INVENTION

This invention relates generally to a loop pin (known as secure a loops) attaching device for tag hanging and more particularly to a loop pin attaching device by which hang tags indicating a price, a material, or the like are attached at a ring-shaped section of various goods to be displayed. This invention also relates to flexible linear loop pin fasteners, each of which is fastened in the shape of a loop, and the provision of a plurality of such loop pin fasteners which are linked together in their unfastened state to form a continuous sheet of loop pin fasteners oriented in the same direction.

Flexible loop pin fasteners are known in the art and are useful for a variety of applications. For example, U.S. Pat. No. 4,240,183 discloses such fasteners. Generally, these loop pin fasteners comprise an insertion portion and a receiving portion which are joined by a flexible linear fiber member. The fiber member is preferably made of a plastic material which is made narrow by the use of a stretching or centrifugal process, which makes the fiber flexible but firm and strong. The insertion section is formed with a conical or otherwise flared tip, and the base of the cone or flare is joined to a narrowed cylindrical section which is itself joined at its distal end to an enlarged cylindrical section formed at a first end of the fiber member. The receiving portion is formed at the second end of the fiber member and is provided with an aperture for receiving the insertion portion such that the conical or flared kip may be inserted through the aperture with moderate force and, once inserted, the insertion portion is locked within the aperture by the engagement of the base of the conical or flared tip, as well as the edges of the enlarged cylindrical section, with the walls of the aperture.

Fastening is accomplished by bending the flexible fiber member and inserting the insertion portion of the fastener into the receiving portion, thereby locking the insertion portion and forming a closed loop. Once locked, the loop pin fastener can only be broken by cutting or otherwise breaking the fiber member. Such loop pin fasteners are particularly useful for such applications as fastening hanging tags to goods, securing goods together and ensuring that the goods have not been separated, temporarily repairing a net, connecting splints to vines in agricultural applications, and so forth.

Loop pin fasteners of the type described above conventionally have been manufactured as molded shots affixed on a spine and stretched. The spine is formed as a plurality of connecting members between adjacent sockets and adjacent fibers, making the loop pin fasteners difficult to separate. Therefore, the individual loop pin fasteners are separated prior to shipping and are placed in containers in loose, disorganized piles.

In use, a sales clerk or other user must select each fastener individually, separating it from other fasteners with which it may be entangled, orient the fastener to the desired alignment with the goods to be fastened (threading the inserting part and a portion of the fiber through the goods if necessary), and manually insert the inserting part through the socket aperture to close and lock the loop. Accordingly, this manual operation using disorganized, individual fasteners is time-consuming and inefficient, especially where such fasteners must be applied repetitively. Moreover, the repetitive manual application of such fasteners by the method described above can cause physical disorders for the user such as carpal tunnel syndrome or tendovaginitis.

As a result, devices known as fastener guns or loop pin attaching devices have been devised which allow an operator to automatically apply a loop pin fastener of the type described above, thereby increasing efficiency and reducing the likelihood of causing physical disorders. Preferably, the gun contains a magazine which may be loaded with a plurality of fasteners which are selectively applied by the user upon operation of the fastener gun. However, if the loop pin fasteners are supplied in the conventional disorganized and entangled manner, the fastener gun must still be loaded with individual fasteners and the user must therefore still select, untangle, and orient each individual fastener for loading in the fastener gun magazine. Thus, a plurality of fasteners is preferably supplied in a single continuous sheet for loading in the gun.

One conventional fastener continuous sheet, as described briefly above, uses individual links bridging each pair of fasteners, one set of links disposed near the insertion portions and one set disposed near the receiving portions, the links being aligned in the plane of the continuous sheet and running perpendicularly to the direction of extension of the fibers. Such an arrangement suffers, however, in that the cutters in the fastener gun used to separate the loop pin fasteners from the links must be arranged to cut through the plane of the continuous sheet, which could result in inadvertent cutting of the fasteners themselves. Further, because the links are disposed not only at two ends of the fastener (generally the insertion portion end and the receiving portion end) but also on two sides of the fastener (to connect each fastener to the two adjacent fasteners), four links are actually attached to each fastener. Accordingly, four cuts are necessary to detach each fastener from the assembly. If only two cuts are used to detach each fastener, at least a portion of each link is left attached to the fastener. These attached links usually leave a sharp edge that it is unacceptable for use with garments having delicate fabrics, or in when used to attach hang tags to eyeglasses because of the danger to the eyes of a customer trying on the eyeglasses. Finally, even after the links have been detached from the fasteners, each link remains as a small, individual unit requiring disposal. After applying several fasteners, many of these discrete, discarded links will accumulate making disposal of the many links difficult and increasing the possibility that these small links may foul the mechanism of any fastener gun.

A second conventional fastener assembly forms a spine or runners at the very top of the socket and inserting part respectively. However, this provides little stability to the fasteners themselves making the assembly inapplicable to automated use with a fastener gun.

Accordingly, it is desired to provide flexible loop pin fasteners of the type described above in a continuous sheet which overcomes the shortcomings of the prior art and which may be easily loaded and operated upon by a fastener gun.

Additionally, it is desirable to provide such an improved loop pin attaching device or fastener gun which overcomes the shortcomings of the prior art and allows for the application of the improved continuous sheet of loop pin fasteners to the goods or the like. Such an improved loop pin attaching device should improve the overall efficiency of the operation of attaching a loop pin and of hanging a tag therefrom, and improve the efficiency of the loop pin insertion operation, during which the insertion portion of the loop pin is inserted into the receiving portion by allowing for the insertion of loop pins other than individually. An improved loop pin attaching device should also shorten the time required for insertion and formation of the loop and provide a loop pin attaching device for tag hanging which will not cause injury to the operator such as tendinitis or the like.

SUMMARY OF THE INVENTION

Generally speaking, in accordance with the invention, an improved fastener assembly is provided for easy loading in a fastener gun, the assembly is formed in a continuous sheet and is formed so as to also be easily operated upon by the fastener gun. The fastener assembly is formed in a continuous sheet and comprises a plurality of fasteners and at least one runner, wherein the fasteners are disposed in a predetermined direction and substantially coplanar with one another to form a plane, and each of the fasteners is attached to the at least one runner by one link, the at least one runner being spaced from the plane of fasteners.

Also in accordance with the invention, an improved loop pin attaching device is provided for hanging a tag from a good or the like. This loop pin attaching device is formed with a drive lever which is connected to a first end of a link. This drive lever is biased in a first direction. A piston member which is connected to a second end of the link is equipped with a pipe-shaped pressing body at the front section thereof. An insertion guide for a loop pin in which the pipe-shaped pressing body slides is also provided. A rack gear is connected to the link in the vicinity of the second end of the link. A gear group formed of a plurality of individual gears which meshes with and engages the rack gear is also provided. A belt is further provided which engages a large diameter gear of the gear group. A receiving guide is provided for positioning a receiving portion of the loop pin and receiving the insertion portion of the loop pin when it is pushed and fed through the receiving portion. This insertion is achieved by the movement of the insertion guide holding the insertion portion of the loop pin toward the receiving guide holding the receiving portion until the insertion portion has been inserted in the receiving portion. Therefore, when the drive lever is actuated after a loop pin has been set within the loop pin attaching device, it is possible to attach the loop pin to a target position utilizing a "one touch" operation.

If a plurality of loop pins are formed as a continuous sheet of loop pins as noted above, these loop pins can each be attached to a different target, one at a time by successively pressing the drive lever. Each press will cause the above-mentioned operation to be performed, and a new loop pin need not be loaded prior to each operation. A continuous operation becomes possible and the operational efficiency is markedly improved. Also, the burden on an operator is reduced to a great extent.

Accordingly, it is an object of this invention to provide fasteners for easy and efficient use with a fastener gun or loop pin attaching device.

Another object of this invention is to provide fasteners which are easily operated upon and applied by a fastener gun or loop pin attaching device.

A further object of this invention is to provide a plurality of fasteners which are linked together to form a continuous sheet of fasteners which are oriented in the same direction for improved loading into and use in a fastener gun or loop pin attaching device.

A still further object of this invention is to provide a plurality of fasteners linked together to form a continuous sheet such that the fasteners may be separated easily and with a minimum number of discrete pieces of discarded material.

Still another object of this invention to provide an improved fastener gun or loop pin attaching device for hanging tags from a good or the like.

Another object of the invention is to provide an improved fastener gun or loop pin attaching device which improves the efficiency of the insertion operation.

A further object of the invention is to provide an improved loop pin attaching device which will reduce the occurrence of injury to the operator.

Yet another object of the invention is to provide an improved loop pin attaching device which utilizes a plurality of loop pins formed in an improved continuous sheet so consecutive operations may be performed without stopping to load the device after each operation.

Still other objects and advantages of the invention will in part be obvious and will in part be apparent from the specification and drawings.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
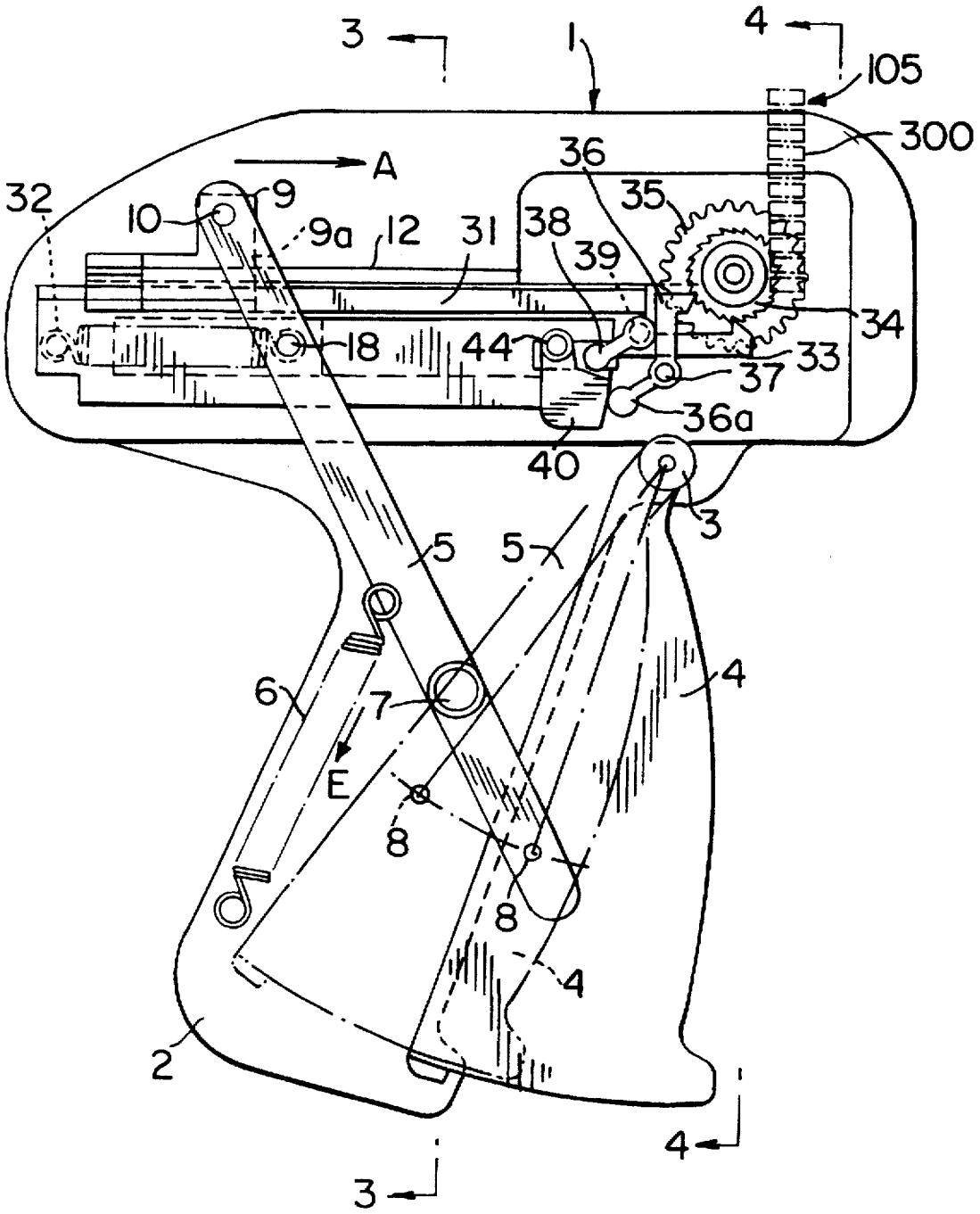
FIG. 1 is a side elevational view which depicts the mechanism of a loop pin attaching device for tag hanging constructed in accordance with the invention without the guide.
Figure 2:
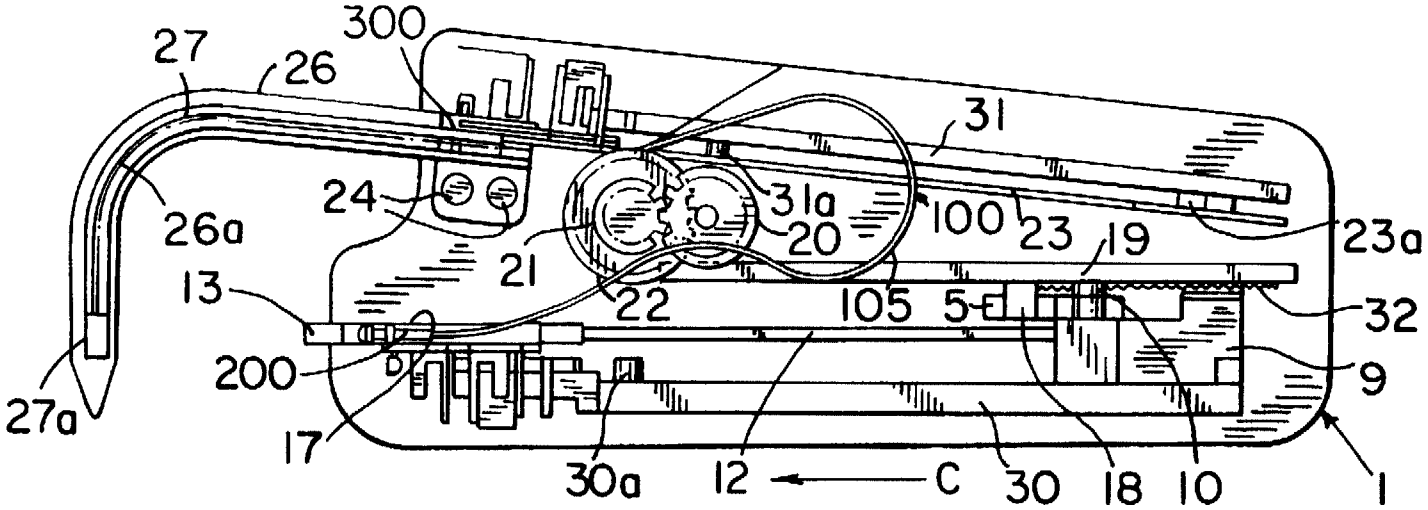
FIG. 2 is a top plan view of the loop pin attaching device of FIG. 1.
Figure 3:
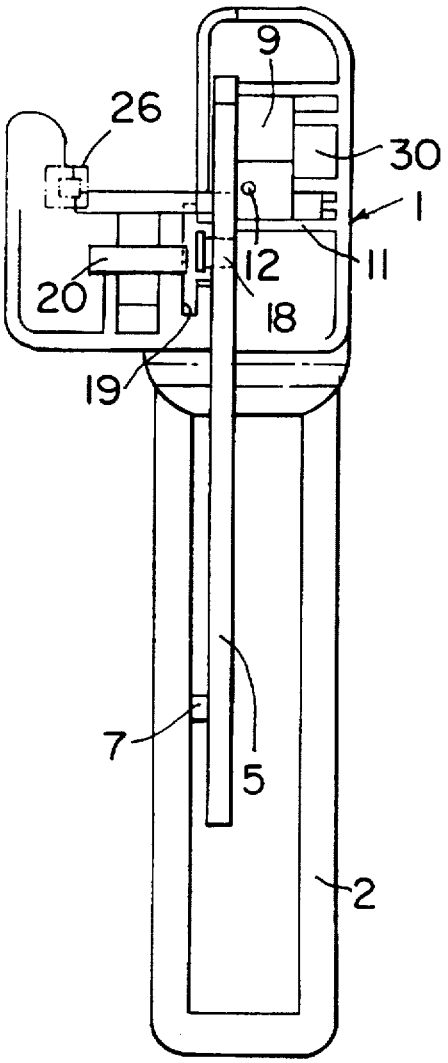
FIG. 3 is a cross sectional view along line 3—3 of FIG. 1.

Reference is first made to FIGS. 1–3 which depict a loop pin attaching device constructed in accordance with the invention in which reference numeral 1 denotes a casing, and reference numeral 2 denotes a grip section of casing 1. Grip section 2 is formed with an opening at the front thereof. A drive lever 4 is pivotably supported on casing 1 at a shaft 3. Lever 4 is disposed within the opening and selectively positionable between a first, unpressed position outside of grip section 2 (as shown by solid lines) and a second, pressed position within grip section 2 (as shown in phantom).

A shaft 7 is mounted within grip section 2. A link 5 is supported on shaft 7 and is pulled and biased in the direction of arrow E in FIG. 1 by a coil spring 6 maintained within grip section 2. A lower end of link 5 is rotatably fixed to drive lever 4 by a pin 8. As constructed, drive lever 4 is biased in the forward direction. A guide plate 11 is mounted within casing 1 (FIG. 3). A piston member 9 is slidably mounted against guide plate 11. An upper end of link 5 is rotatably fixed to piston member 9 by a pin 10. Piston member 9 is slidable along guide plate 11 in reciprocating motion as urged by link 5 due to the action of drive lever 4.

A rack gear 19 is mounted within casing 1. Link 5 is rotatably fixed near its upper end to rack gear 19 by a pin 18 (FIGS. 2 and 3). A first gear 20 having a medium diameter is positioned and adapted to mesh with and engage rack gear 19. First gear 20 is also positioned and adapted to mesh with and engage a second gear 21 having a diameter smaller than first gear 20. A third gear 22 having a diameter larger than first gear 20 is positioned and fixed coaxially to second gear 21.

A pipe-shaped pressing body 12 is mounted at a front face 9*a* of piston member 9. A first end 12*a* of pressing body 12 is disposed against piston member 9. A second end 12*b* of pressing body 12 is formed with a slit 12*c* therein. An insertion guide 13 is mounted on casing 1. Pressing body 12 is selectively moveable in a direction of arrow G between a first position wherein none of pressing body 12 is maintained within insertion guide 13 and a second position wherein a portion of pressing body 12 is maintained within insertion guide 13.

Figure 11:
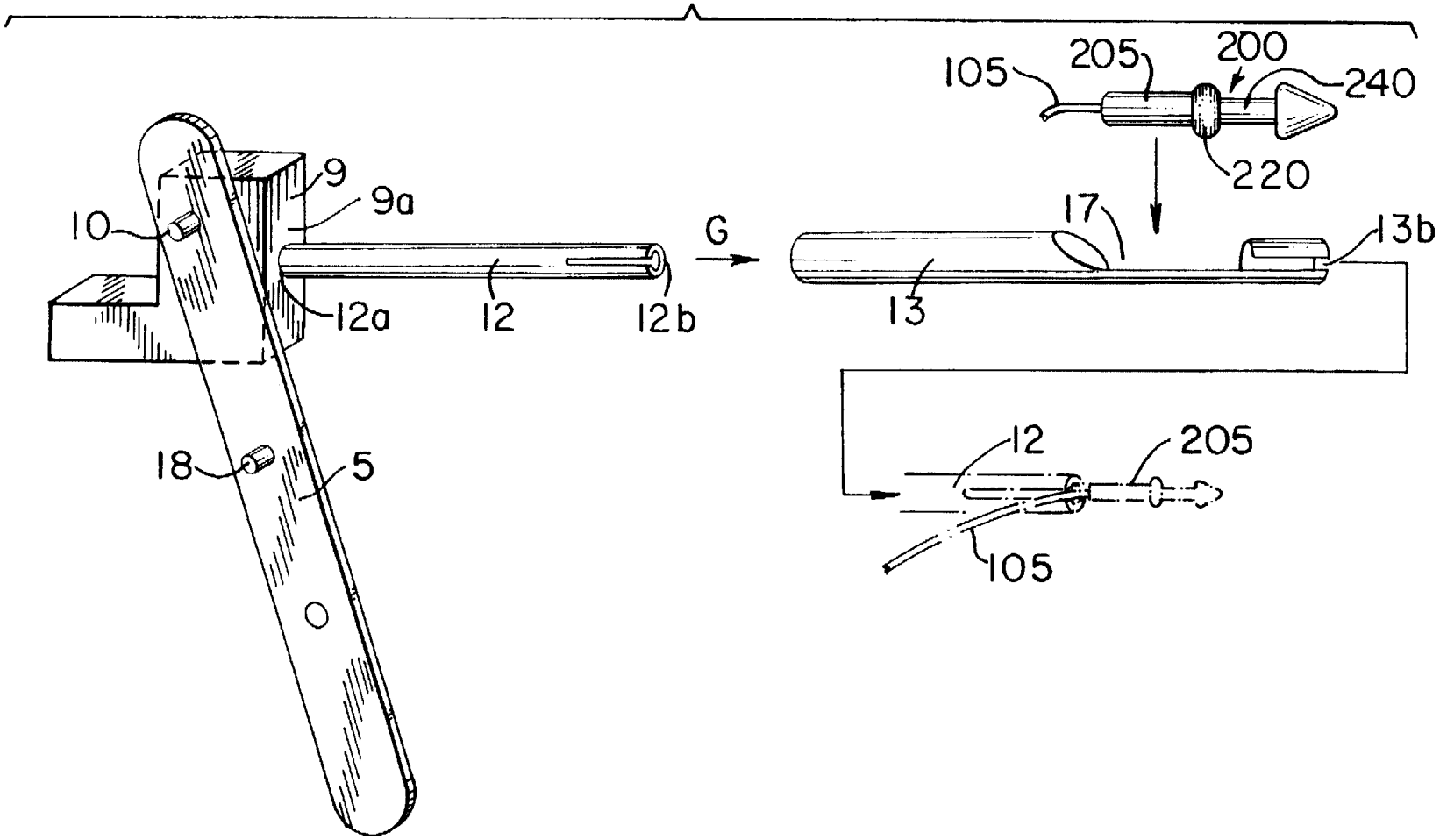
FIG. 11 is a perspective view of an insertion portion of a loop pin and a pipe-shaped pressing body constructed in accordance with the invention.

Insertion guide 13 is formed as a substantially straight pipe. A notch 17 is formed along the outer face of insertion guide 13. Notch 17 is dimensioned to receive an insertion portion 200 of a loop pin fastener 100. When inserted, a fiber member 105 of loop pin fastener 100 passes outside of insertion guide 13, as shown in FIG. 2. Fiber member 105 of loop pin fastener 100 is dimensioned to be retained within slit 12*b* during insertion as shown in FIG. 11. Slit 12*b* in pipe-shaped pressing body 12 functions to hold loop pin fastener 100 and feed it as pressing body 12 moves in the direction of arrow G. A slit 13*b* of insertion guide 13 acts as an exit to allow fiber member 105 to pass therethrough. Once connected, fiber member 105 passes through an opening in casing 1 to allow release of the closed loop pin.

A flexible belt 23 is mounted in casing 1. Third gear 22 engages flexible belt 23. The connection of gears provides a gear ratio advantage to belt 23. Through this gear ratio, belt 23 moves faster than the movement of piston member 9, and therefore moves through the action of the gear ratio from the operation of drive lever 4. Thus, when drive lever 4 is depressed, piston 9 is moved at a first speed driving gears 20, 21, 22, and belt 23 moves in the direction of an arrow H (FIG. 12) at a faster, second speed, being driven by driving gears 20, 21 and 22.

Figure 4:
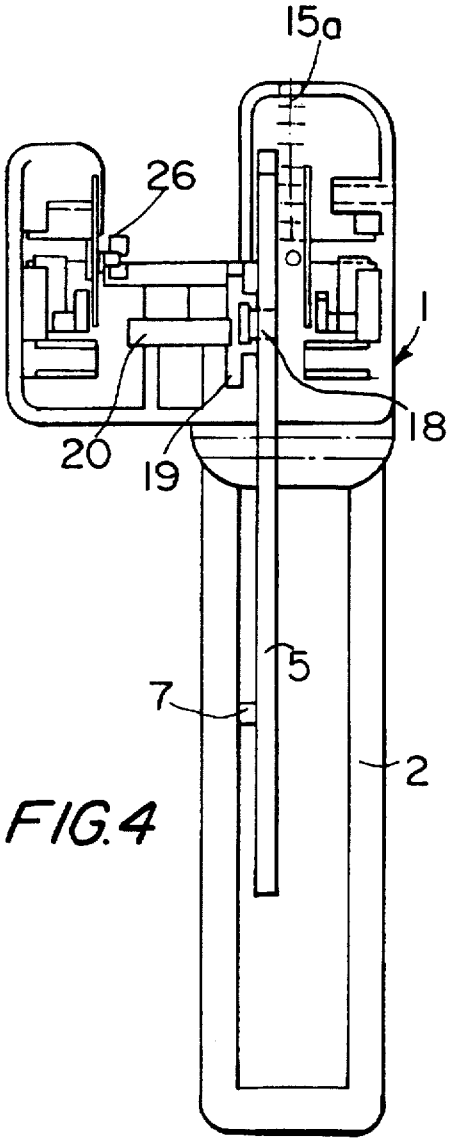
FIG. 4 is a cross-sectional view along line 4—4 of FIG. 1.
Figure 12:
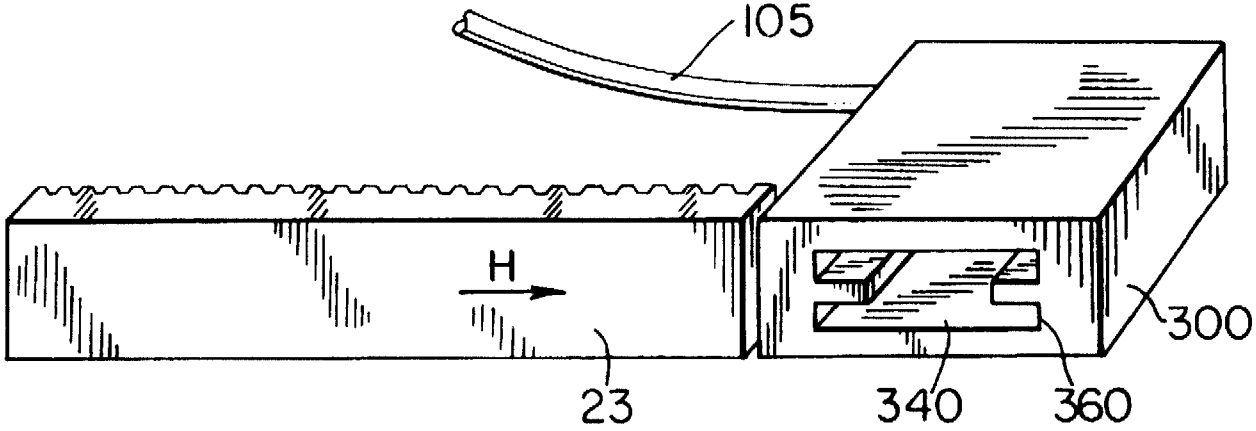
FIG. 12 is a perspective view of a belt and a receiving guide end portion constructed in accordance with the invention.
Figure 13:
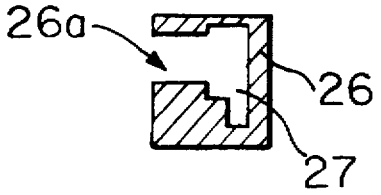
FIG. 13 is a cross-sectional view of a base end of a receiving guide constructed in accordance with the invention.

As is shown in FIG. 2, and 4 and also FIGS. 12 and 13, a receiving guide 26 mounted on casing 1 is formed with a J-shape. A receiving portion 300 of loop pin fastener 100 is attached to a corresponding position of belt 23 as is shown in FIG. 12. As is further shown in FIG. 2 and FIG. 13, a groove 27 is formed through receiving guide 26 and extends the full curved length thereof. Groove 27 is further formed with a corresponding slit 26*a* which also extends the full curved length of receiving guide 26. Slit 26*a* is formed on the inner curved surface of receiving guide 26, and allows fiber member 105 of insertion portion 200 of loop pin fastener 100 to pass through and extend therethrough when receiving portion 300 is moved along groove 27. A notch 27*a* is formed at the end of groove 27 to receive receiving portion 300.

During use, each loop pin fastener 100 is formed into a loop as follows. Loop pin fastener 100 is originally retained within the mechanism, in a folded fashion, as shown in FIG. 2, insertion portion 200 and receiving portion 300 being positioned opposing each other. As noted above, insertion portion 200 is retained within insertion guide 13 and receiving portion 300 is retained within receiving guide 26 and is connected to belt 24. By gripping drive lever 4 and actuating it by pressing it, thereby acting against the bias force of coil spring 6, piston member 9 is urged in the direction indicated by arrow A in FIG. 1. This motion causes slit 12*b*, formed in the tip of pipe-shaped pressing body 12 of piston member 9 to contact loop pin 100 at the base end of insertion portion 200 and pushes loop pin 100 in the direction of arrow G to exit casing 1. Fiber member 105 passes from pressing body 12 through slit 12*b*. Simultaneously, belt 23 pushes and transports receiving portion 300 in the direction of arrow H through groove 27 of receiving guide 26 toward notch 27*a* through the operation of gears 20, 21 and 22. The gear ratio advantage provided thereby causes receiving portion 300 to move faster in receiving groove 26 than insertion portion 200 moves. The gear ratio is set so that receiving portion 300 reaches notch 27*a* at the same time insertion portion 200 reaches notch 27*a*. When receiving portion 300 reaches its final position at notch 27*a*, insertion portion 200 also arrives and is forced to pass through receiving portion 300, thereby forming a loop. After the loop is formed, this loop is released from the device, the loop being able to pass easily through slits 13*b* and 26 and an opening at the front of casing 1.

As is shown in FIGS. 2 and 3, a sliding rail 30 is positioned adjacent piston member 9 and parallel to the sliding direction thereof. A second sliding rail 31 is provided adjacent belt 23 and parallel to the direction of movement thereof. A coil spring 32 is suspended between the back face of rack gear 19 and pin 18. Because of the gear ratio discussed above, a difference in speed is generated between gear rack 19 and second sliding rail 31. Thus, an escape position is provided which allows pin 18 and piston 9 to continue to advance insertion portion 200 even after receiving portion 300 reaches its predetermined position. Therefore, it is not necessary that insertion portion 200 and receiving portion 300 reach notch 27*a* at precisely the same, time, as long as receiving portion 300 arrives first.

Figure 16:
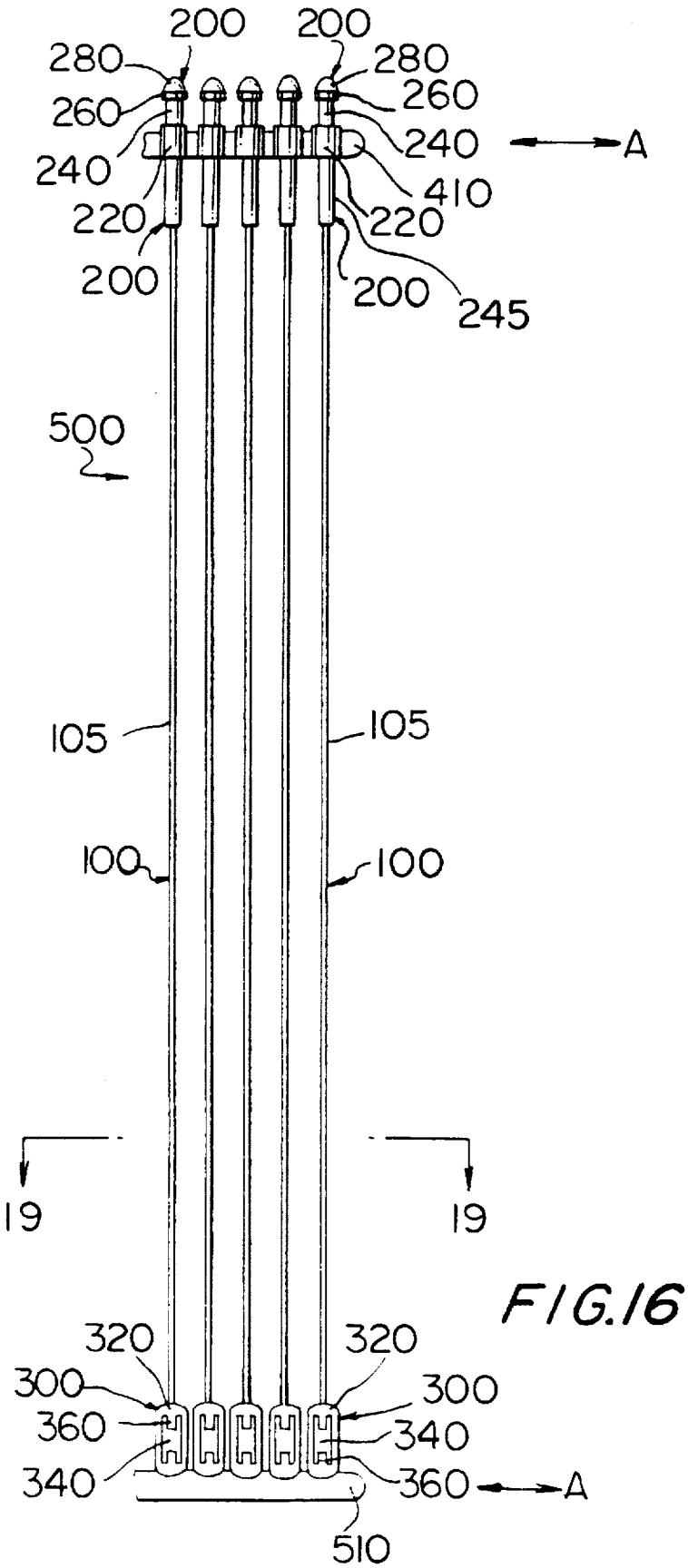
FIG. 16 is a top plan view of a fragment of a continuous sheet of loop pins constructed in accordance with a first embodiment of the invention, the remainder of the sheet being similarly constructed.
Figure 17:
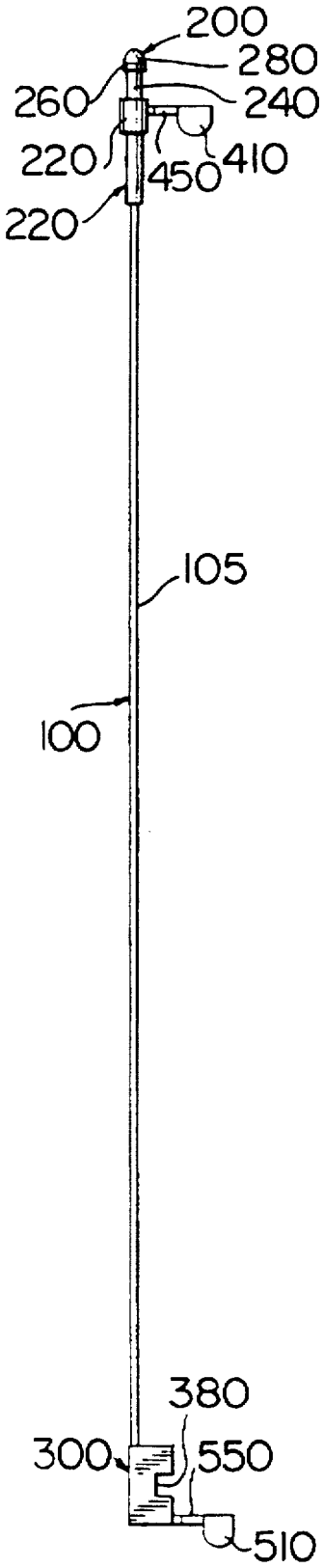
FIG. 17 is a side elevational view of the continuous sheet of loop pins of FIG. 16.
Figure 18:
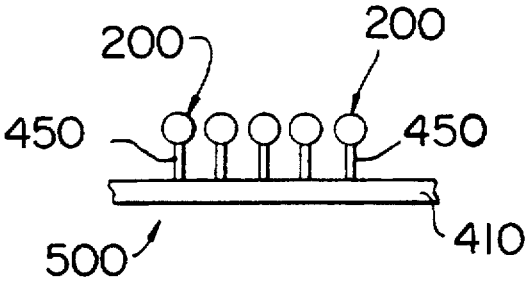
FIG. 18 is a top plan view of the continuous sheet of loop pins of FIG. 16 taken in the direction of arrow Z.
Figure 19:
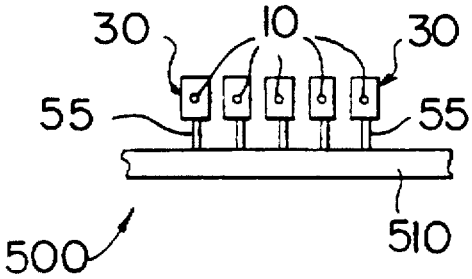
FIG. 19 is a sectional view taken along line 19—19 of FIG. 16.
Figure 20:
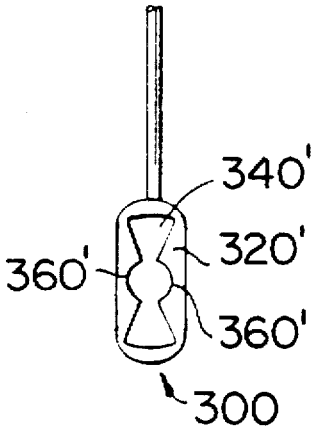
FIG. 20 is a top plan view of a receiving portion constructed in accordance with a second embodiment of the invention.

The structure of the loop pins will be more specifically described with reference to a first embodiment of the loop pins, as depicted in FIGS. 9, 12, 16–19. As shown in FIGS. 16 and 17, a plurality of fasteners 100 are provided. Each fastener 100 generally comprises a fiber member 105, an insertion portion 200 and a receiving portion 300. The insertion portion 200 and receiving portion 300 are disposed at opposite ends of the generally linear fiber member 105. Fiber member 105 is elastic and flexible and is preferably made of plastic formed by a stretching or centrifugal process so as to create a relatively thin but firm and strong fiber.

Insertion portion 200 (shown more closely in FIG. 9) comprises a wide diameter section 220, a generally conical head 280 with a stepped section 260 at the base of head 28. A neck 240 having a diameter less than the greatest outer diameter of head 280 extends from head 280. Wide diameter section 220 forms a collar at the base of neck 240. An extending portion 245 connects wide diameter section 220 with fiber member 105.

Receiving portion 300 comprises a second collar 320 through which is provided an aperture 340. Collar 320 is also provided with one or more resilient anchoring protrusions 360 which protrude into aperture 340 to form an inner diameter. The outer perimeter of collar 320, is by way of example, rectangular in shape and may be provided with rounded sides as shown. Stepped section 260 and collar 220 of inserting part 200 are both wider in diameter than the inner diameter formed between anchoring protrusions 360 within aperture 340, although stepped section 260 is preferably only slightly so. In addition, neck 240 is preferably at least as narrow as the inner diameter of aperture 340 and at least as long as the depth of anchoring protrusions 360 within aperture 340. All of the above components are preferably molded in plastic as a single article.

As noted above with respect to the use of the fastener gun, fastener 100 may be formed into a locked, closed loop by bending fiber member 105 such that insertion portion 200 is inserted into receiving portion 300. Head 280 of inserting part 200 is pushed through aperture 340 deflecting anchoring protrusions 360 such that stepped section 260 clears anchoring protrusions 360 with the use of some force. Once stepped section 260 is clear of anchoring protrusions 360, protrusions 360 return to their original position behind stepped section 260 so that insertion portion 200 is locked to receiving portion 300 due to the locking of the anchoring protrusions 360 between the stepped section 260 and collar 220 of insertion portion 200, both of which are of a larger diameter than the inner diameter of aperture 340. To maintain a compact and regularly shaped locking portion and to improve stability of the locking engagement of insertion portion 200 within receiving portion 300, receiving portion 300 may be provided with a notch 380 to prevent the end of tip 280 from protruding beyond the walls of receiving portion 300 and to embrace the sides of stepped portion 260 to thereby stabilize the tip within receiving portion 300.

As shown in FIGS. 9, 16–19, an assembly 500 of fasteners 100 includes a plurality of fasteners 100, a first runner 410 and a second runner 510. The plurality of fasteners 100 are all arranged substantially in a plane in a continuous sheet, in the same predetermined orientation, and each fastener is spaced a predetermined distance from the fastener or fasteners adjacent to it in the rack. First runner 410 and second runner 510 are each disposed parallel to the plane of the fasteners and perpendicular to the direction of extension of the fiber members 105 thereof. Each of the plurality of fasteners 100 is attached to first runner 410 by a first flange 450 and to second runner 510 by a second flange 550. Flange 450 connects first runner 410 to a side of insertion portion 200, and in particular to collar 220, substantially perpendicularly to fastener 100. Flange 550 connects second runner 510 to a face of receiving portion 3013 perpendicular to aperture 340 adjacent aperture 340. Flange 550 forms a substantially right angle with the face of receiving portion 300. As a result, flanges 450 and 550 space runners 410 and 510 from fasteners 100.

Assembly 500 permits a great number of fasteners 100 to be manufactured, stored, shipped, selected and used by a user in an orderly and efficient manner. Each of the fasteners is oriented in the same direction which reduces potential entanglement with other fasteners. Furthermore, when assembly 500 is molded in plastic as a single, unitary article, as is preferable, runners 410 and 510 may be used as the area of the mold into which the plastic is injected. In this way, imperfections in the rack caused by excess plastic at the injection points are isolated to the runners, which are simply discarded after use, and do not affect the fasteners.

Figure 5:
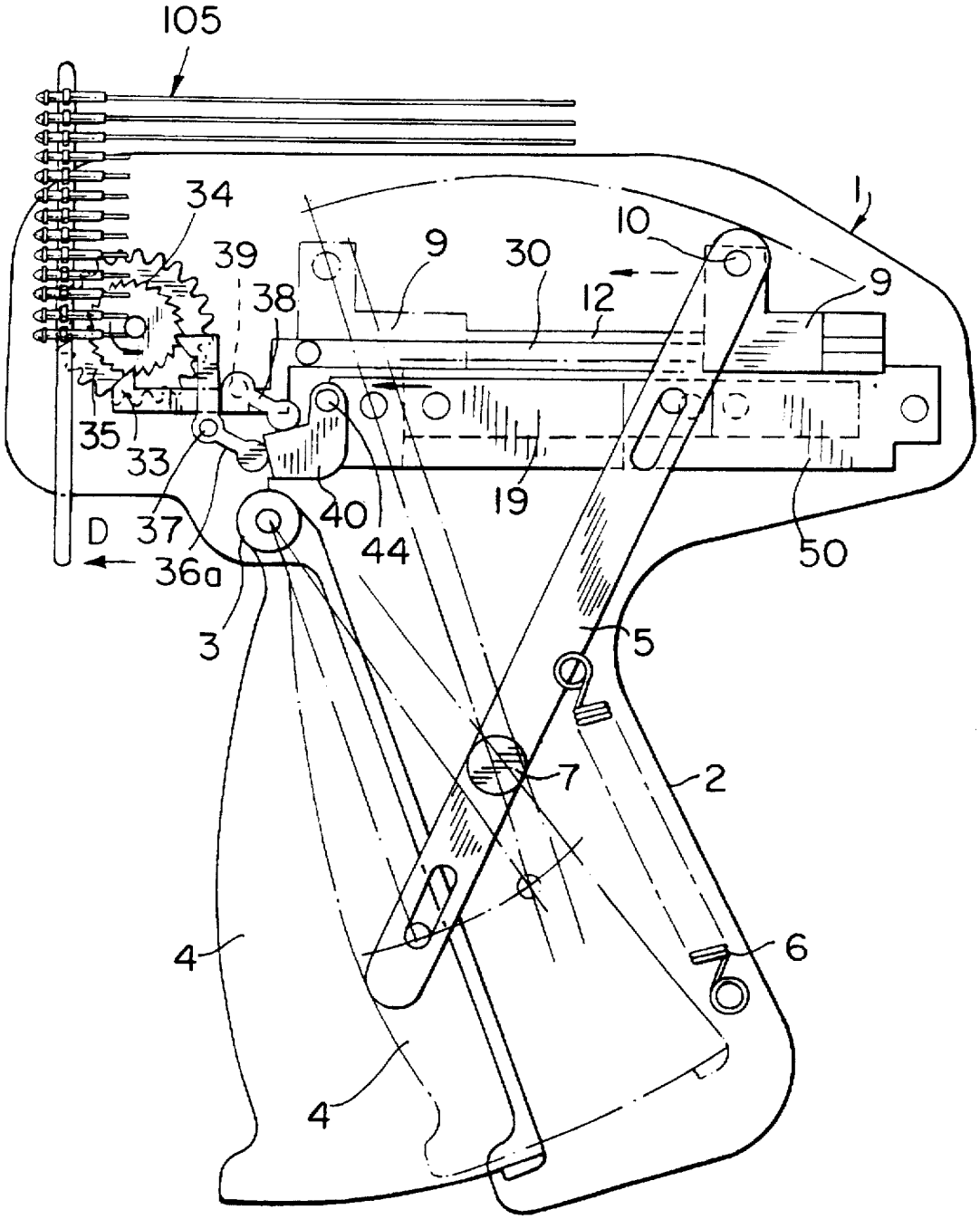
FIG. 5 is a side elevational view of the loop pin attaching device of FIG. 1 from the opposite side thereof.
Figure 6:
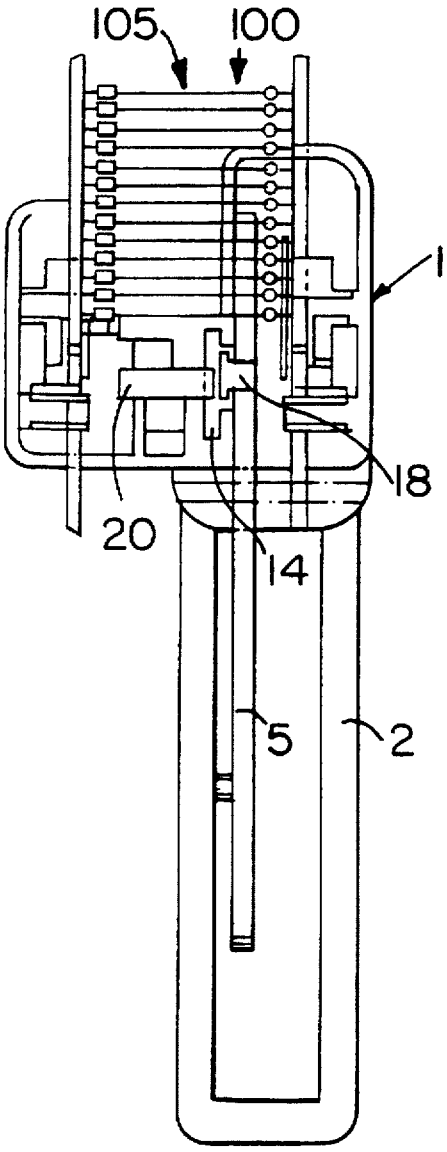
FIG. 6 is a front elevational view of the loop pin attaching device of FIG.
Figure 7:
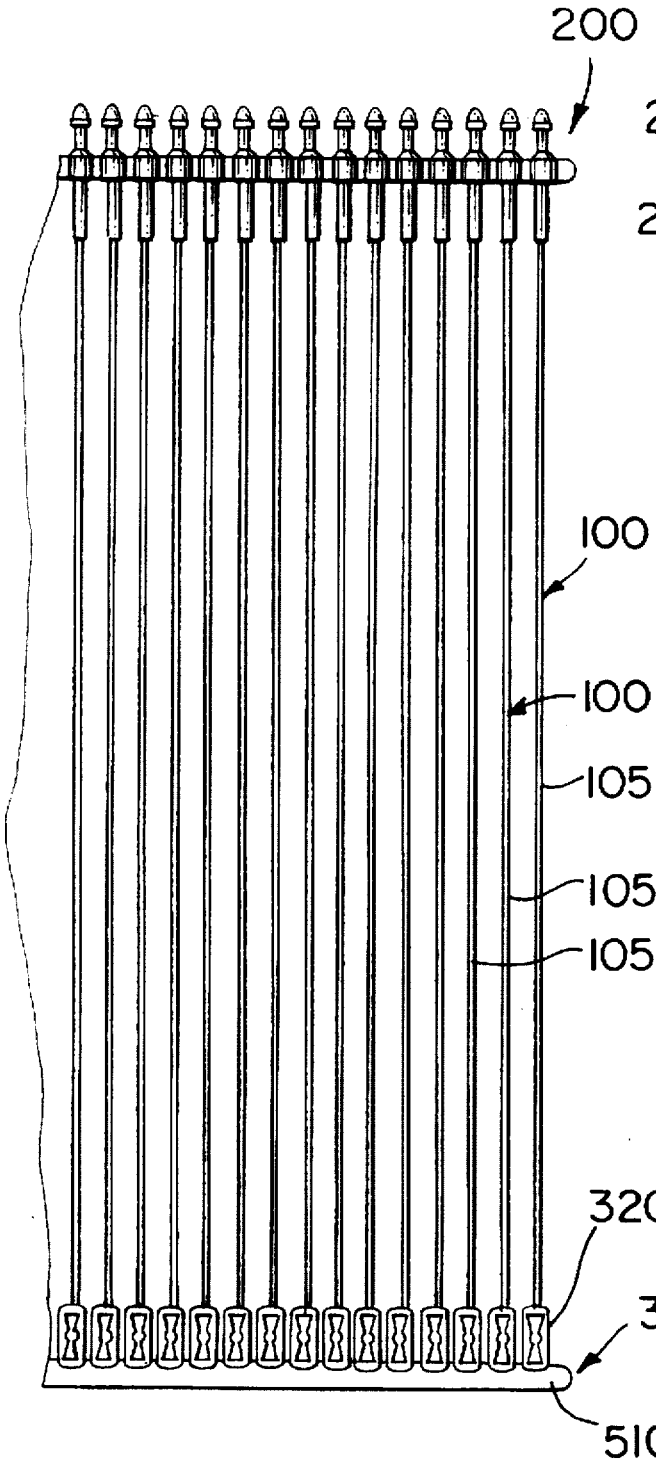
FIG. 7 is a top plan view of a continuous sheet of loop pins constructed in accordance with a second embodiment of the invention.
Figure 8:
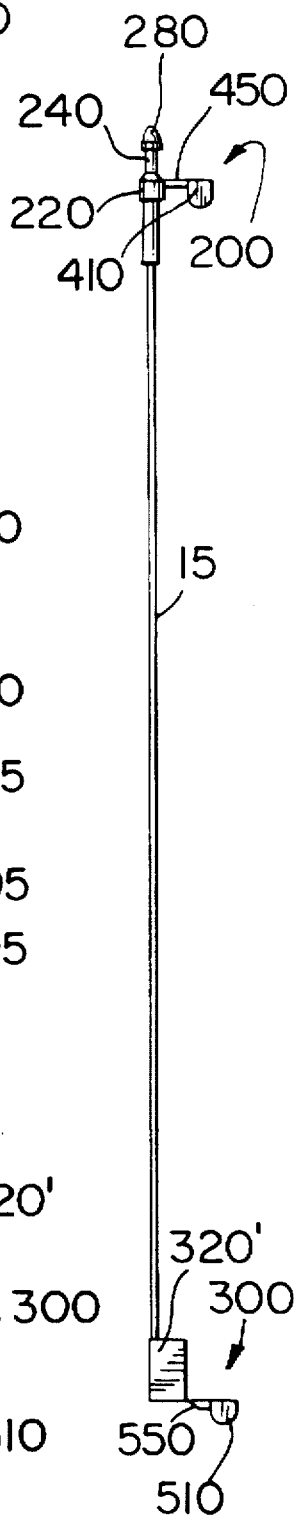
FIG. 8 is a side elevational view of the continuous sheet of loop pins of FIG. 7.
Figure 9:
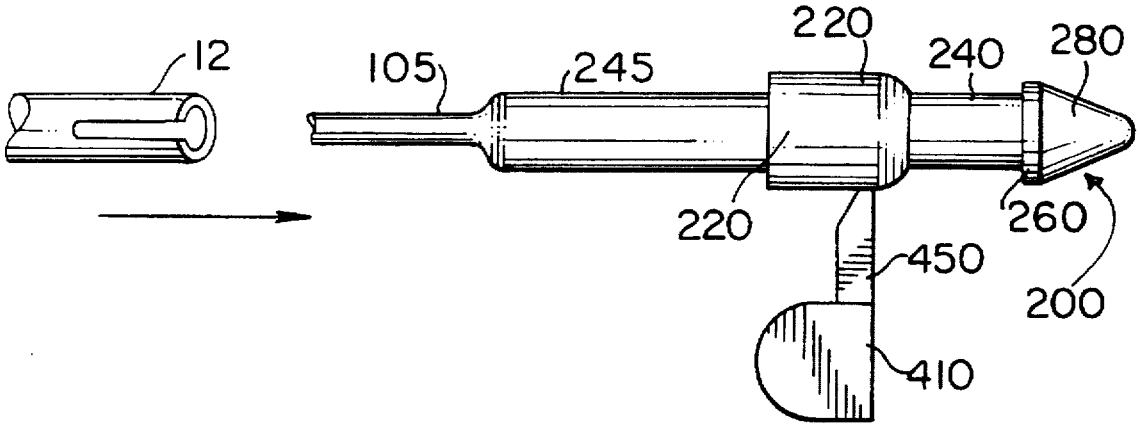
FIG. 9 is an enlarged side elevational view of the insertion portion of a loop pin of FIG. 8 and constructed in accordance with a first embodiment of the invention.
Figure 10:
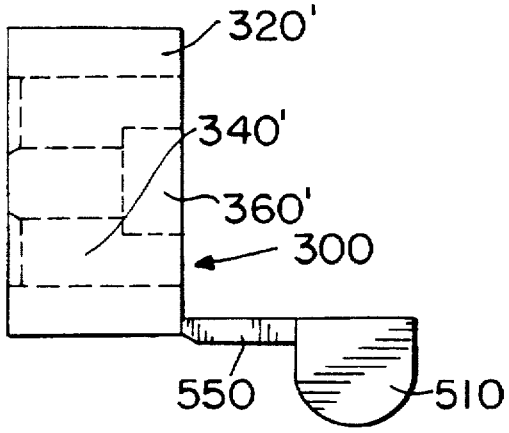
FIG. 10 is an enlarged side elevational view of the receiving portion of a loop pin of FIG. 8.
Figure 22:
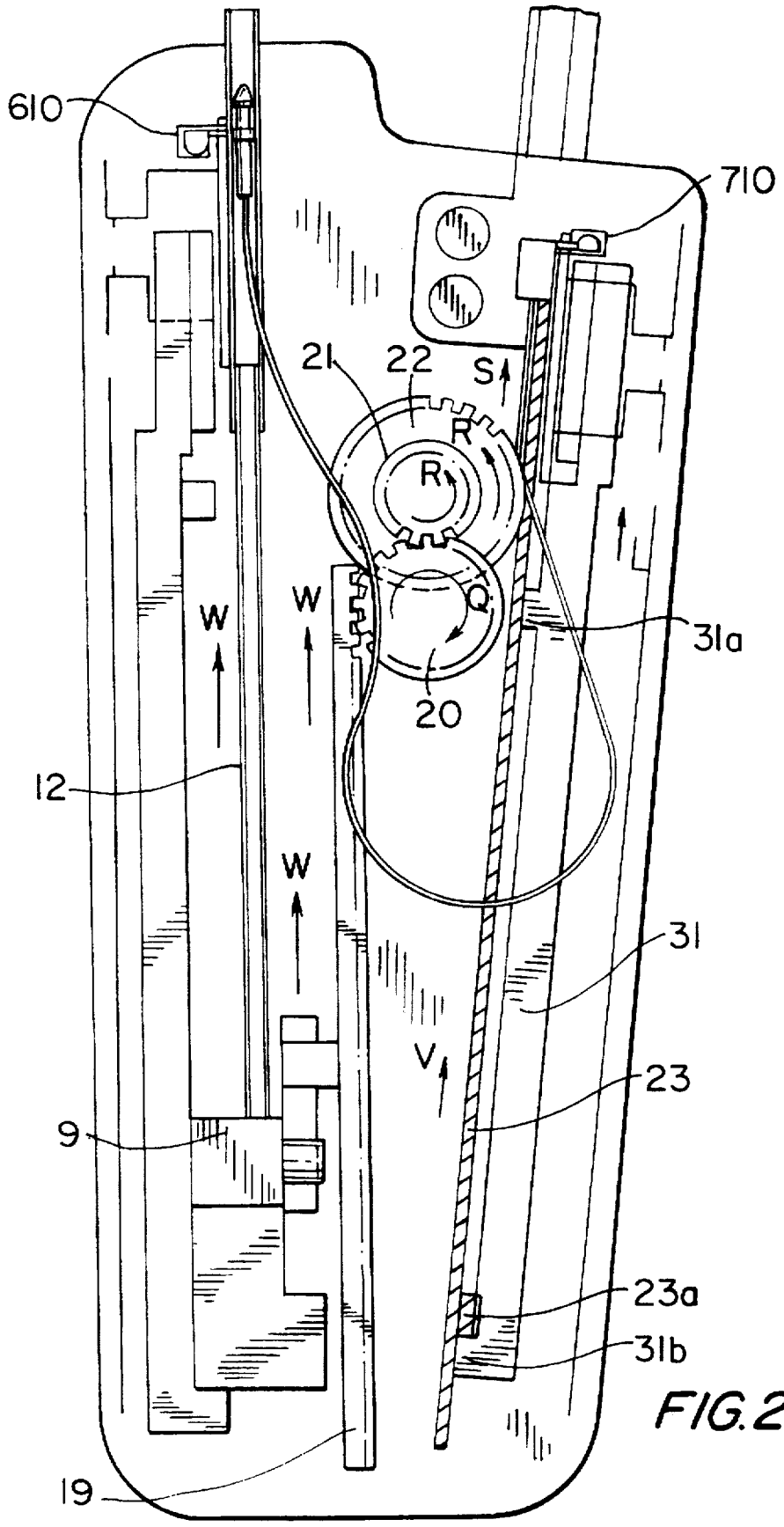
FIG. 22 is a top plan view of the loop pin attaching device of FIG. 1 and depicting the separation of a single loop pin from a sheet.

Moreover, continuous sheet 500 is advantageous for use in a fastening gun because the runners are positioned away from the fasteners. In operation, continuous sheet 500 would preferably be fed into a fastener gun in either of the directions indicated by arrow A of FIG. 16, as is shown in FIGS. 5 and 6. As is shown in FIG. 22, runners 410 and 510 are received, respectively, in runner receiving slots 610 and 710, the remainder of the loop pin being retained between the two runners. To further enhance the operation of such a fastener gun, continuous sheet 500 of the present invention is designed to facilitate the separation of each fastener 100 from the runners 410 and 510. To this end, runners 410 and 510 are both disposed on the same side of the plane of continuous sheet 500 and each runner is attached by flanges 450 and 550 respectively to the same point on each fastener 100. Flange 450 depends from the side of the insertion portion 200 of each fastener 100, preferably from collar section 220. Flange 550 is attached to a side face of insertion portion 300 of each fastener 100, preferably to the outermost end thereof. Both flanges 450 and 550 are preferably disposed substantially perpendicularly to the plane of assembly 500 to distance runners 410 and 510 away from individual fasteners 100.

Accordingly, runners 410 and 510 are permitted to run clear of the plane of fasteners 100; that is, runners 410 and 510 are not coplanar with fasteners 100. This configuration allows a fastener 100 to be removed from both runners 410 and 510 by cutting flanges 450 and 550 in the same plane which is parallel to the plane of fasteners 100. Cutting the flanges 450 and 550 in this same plane is advantageous because both flanges may be cut by the same cutter. Alternatively, two cutters may be disposed along the same support member within the gun which minimizes the number of discrete parts for manufacturing the gun and may allow the gun to be made more compact. Further, attaching flange 450 to the side of insertion portion 200 instead of at the head 280 ensures that the shape of head 280 remains uniform and is not encumbered by unwanted remnant portions of the flange which could interfere with proper insertion of insertion portion 200 into receiving portion 300.

By utilizing a spacer flange between each runner and the fastener, only two cuts need be made to separate each fastener 100 from assembly 500, thus halving the number of cuts which must be made when using conventional assemblies. This results in faster and more efficient operation and reduces the rate of wear on the cutters within the fastener gun. In addition, by providing runners away from the fasteners, the discarded material is neatly kept together in two easily manipulated and disposable members which are unlikely to interfere with the mechanism of the fastener gun.

It is to be noted that assembly 200 need not be arranged in a plane and may be arranged in a curved band or other arrangement so long as the runners are formed to follow the arrangement of the fasteners and the runners do not intersect the fasteners themselves but are held away from the fasteners, such as by the flanges described above. Alternatively, the runners may be made flexible to allow the rack to adopt a variety of configurations including planar, curved or folded arrangements.

The mechanism for detaching and looping each individual loop pin 100 will now be described.

Figure 14:
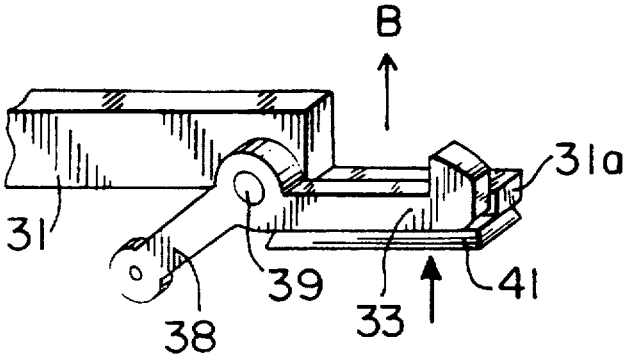
FIG. 14 is a perspective view of a hook pawl mechanism constructed in accordance with the invention.

In FIG. 2, each of stepped extending portions 30*a* and 31*a* is integrally formed respectively at the protruding end of first sliding rail 30 and second sliding rail 31. A ratchet 34 is rotatably mounted in casing 1. A hook member 33 (FIGS. 1, 5 and 14) which has a pawl shaped tip is held and supported at each of side faces by extending sections 30*a* and 31 and a pin 39 extending between extending sections 30*a* and 31*a* and extending through hook member 33. A rear end of hook member 33 is formed into an operating element 38 for releasing the pawl. A plate spring 41 extends between extending portions 30*a* and 31*a* from the lower faces thereof and supports lower face of hook member 33. Hook member 33 is biased in the direction indicated by arrow B in FIG. 14, by plate spring 41, and thus the pawl-shaped tip of hook member 33 is biased toward the center of ratchet 34 (FIGS. 1 and 5) and is allowed to mesh therewith. A feed gear 35 is coaxially mounted on ratchet 34. The teeth of feed gear 35 are dimensioned to fit between adjacent insertion and receiving flanges 450 and 550, respectively and controls the feeding of each individual loop pin 100 from continuous sheet 500. Thus, each ratchet of feed gear 35 moves a next loop pin 100 into position to be used next by the gun.

Figure 15:
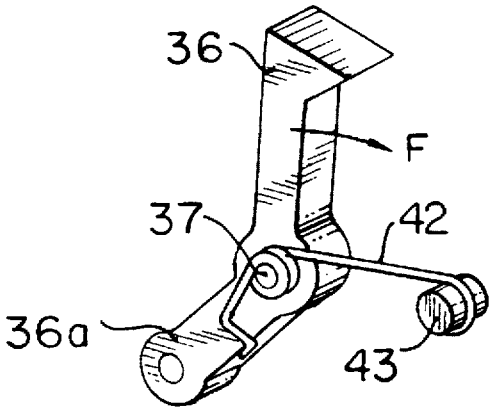
FIG. 15 is perspective view depicting a stopper mechanism constructed in accordance with the invention.

Referring next to FIG. 15, a stopper 36 of ratchet 34 is supported by a pin 37. A first end of stopper 36 is formed with a pawl shape, and a second end is formed into an operating element 36*a* for releasing the pawl. One end of a wound spring 42 is attached to pin 37 and is bent and hooked around operating element 36*a* to bias stopper 36 in the direction of arrow F. The other end of wound spring 42 is wound around a protruding piece 43 mounted on the inner face of casing 1 in a protruding manner. The pawl-shaped upper end of stopper 36 is biased toward the center of ratchet 34 by wound spring 42.

Referring back to FIGS. 1 and 5, a release member 40 is rotatably mounted to a block 50 by a pin 44. Release member 40 selectively engages stopper 36 and hook member 33. Operating element 38 of hook member 33 and an operating element 36*a* of stopper 36 are maintained in contact with release member 40, each on a different perpendicular face thereof with a corner of release member 40 situated between them.

Figure 21:
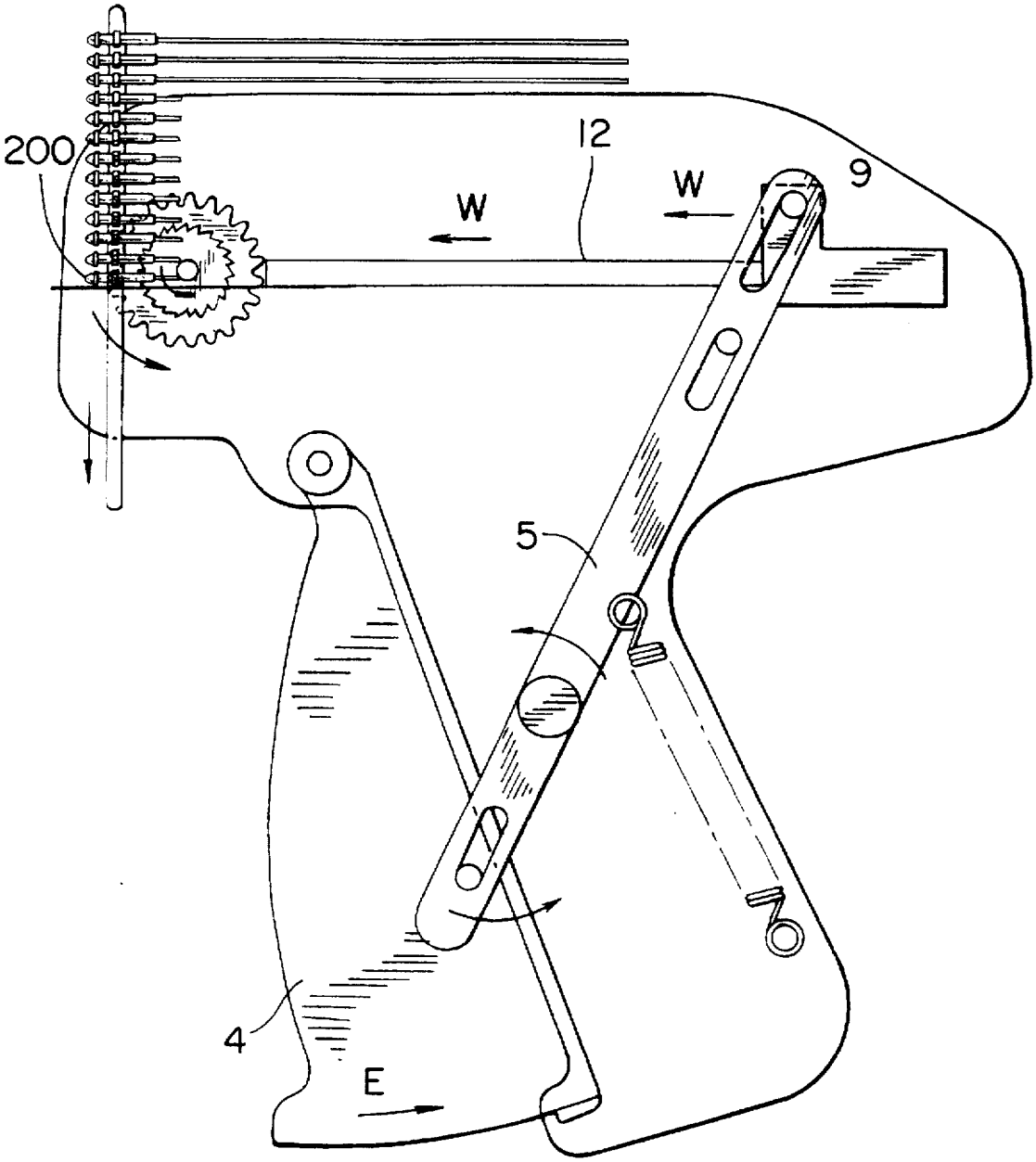
FIG. 21 is a side elevational view of the loop pin attaching device of FIG. 1 and depicting the separation of an insertion portion of a single loop pin from a sheet.
Figure 23:
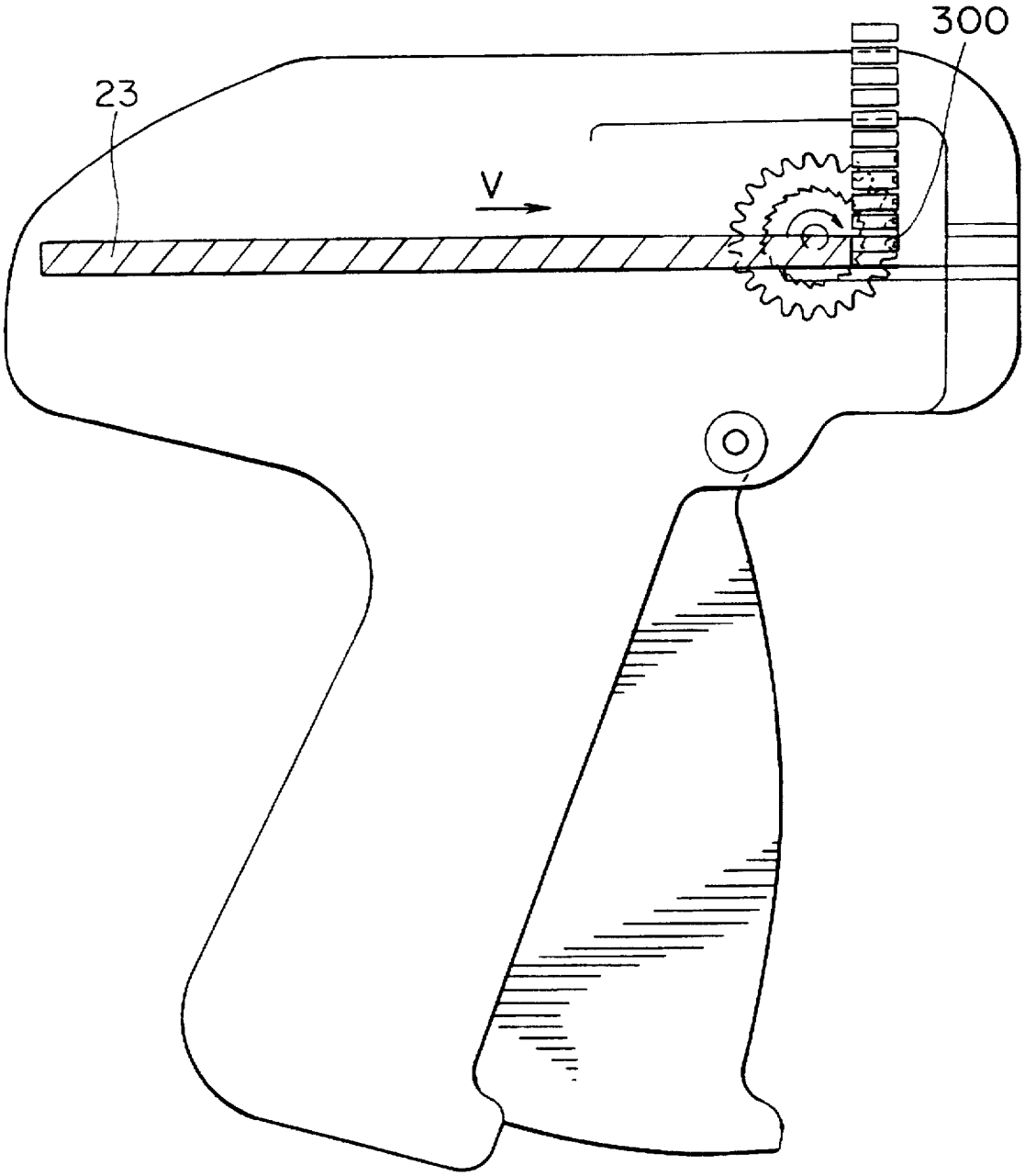
FIG. 23 is a side elevational view of the loop pin attaching device of FIG. 1 and depicting the separation of a receiving portion of a single loop pin from a sheet.
Figure 24:
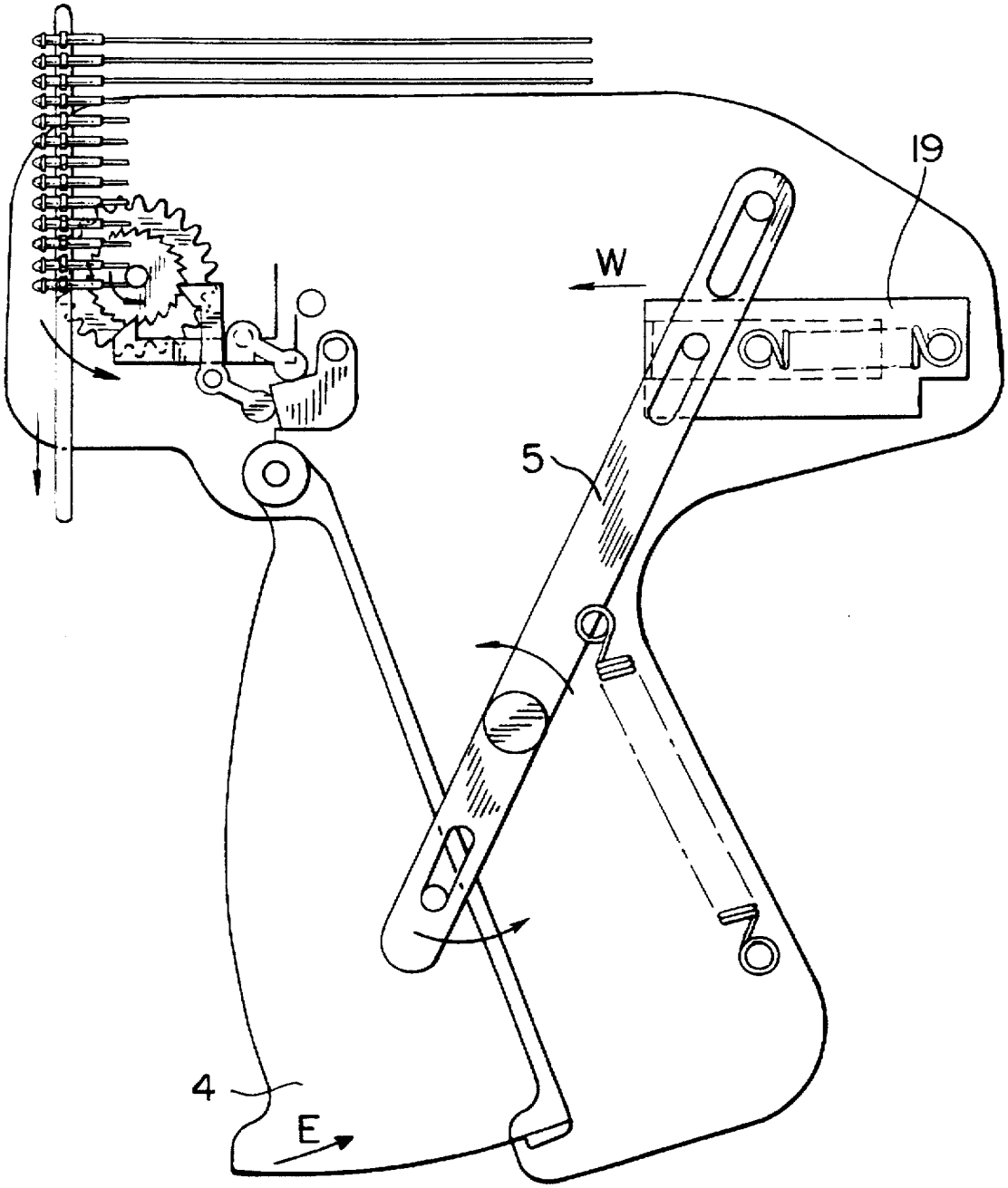
FIG. 24 is a side elevational view of the loop pin attaching device of FIG. 1 and depicting the ratcheting of another loop pin into position.

During use drive lever 4 is pressed in the direction of arrow E, as is also shown in FIG. 21. Protruding piece 30*a* is urged in the direction indicated by arrow C in FIG. 2 by the forward movement of piston member 9, and pipe-shaped pressing body 12 engages extending portion 245. Protruding piece 31*a* is similarly urged in the direction indicated by arrow C in FIG. 2 by the forward movement of a pushing protruding piece 23*a*, which is fixed to belt 23. Belt 23 engages receiving portion 300, as is shown in FIG. 23. The movement of belt 23 is generated by the movement of gear rack 19, which responds to the displacement of drive lever 4. This movement is then translated through gears 20, 21 and 22 to belt 23, as is shown in FIG. 22. Specifically, as gear rack 19 moves in the direction indicated by arrow W (see also FIG. 24), gear 20 rotates in the direction indicated by arrow Q, and therefore, gears 21 and 22 rotate in the direction indicated by arrows R, thereby moving belt 23 in the direction indicated by arrow S. Each of these protruding pieces 30*a* and 31*a* respectively urge pipe-shaped pressing body 12 and belt 23 in the directions indicated by arrows W and S in FIGS. 21 and 23. The force placed on these insertion portion 200 and receiving portion 300, respectively, by pipe-shaped pressing body 12 and belt 23 cuts the loop pin 100 within the gun from runners 410 and 510. Thus, each individual loop pin can be: sheared from the rack, and provided for use in the gun, and each loop pin can be formed into a loop, as discussed above.

Hook member 33 advances one tooth of ratchet 34 upon being urged by protruding pieces 30*a* and 31*a*. When spring 6 is returned to its original state (when the pressure on drive lever 4 is released) and completion of formation of a loop of loop pin 100 has been completed, ratchet 34 is rotated by one pitch and feed gear 35 lowers continuous body 500 by one individual loop pin 100. Next, when drive lever 4 is activated to form the next loop, coupling bodies 28 and 29 are pressed and cut by the movement of protruding pieces 30*a* and 31*a* and the force of pipe shaped-pressing body 12 and belt 23 while insertion portion 200 and receiving section 300 are moved and joined as described above. This pressure on drive lever 4, and its subsequent release moves the next loop pin 100 of sheet 500 into position. Thus, each loop pin is cut from continuous sheet 500 and is individually looped and attached to an object as required by a user.

The movement of each consecutive loop pin into position in the gun will now be described. When drive lever 4 is moved in the direction indicated by arrow E in FIG. 25, piston member 9 moves in the direction indicated by arrow W. Face 9*a* of piston member 9 engages stepped extending portion 30*a*, thereby urging first slider portion 30 in the direction indicated by arrow W against the biasing force of coil spring 6. Similarly, stepped extending portion 31*a*, is engaged by pushing protruding piece 23*a* of belt 23, thereby urging first slider portion 30 in the direction indicated by arrow L in FIG. 22 and 26. When first sliding rail 30 and second sliding rail 31 advance and hook member 33 advances one tooth of ratchet 34, operating element 38 pushes down against release member 40. Next, operating element 36a is pushed in the direction indicated by arrow D in FIG. 5 by this movement and stopper 36 is disengaged from ratchet 34 against the biasing force of wound spring 42, thereby allowing ratchet 34 to rotate.

Figure 25:
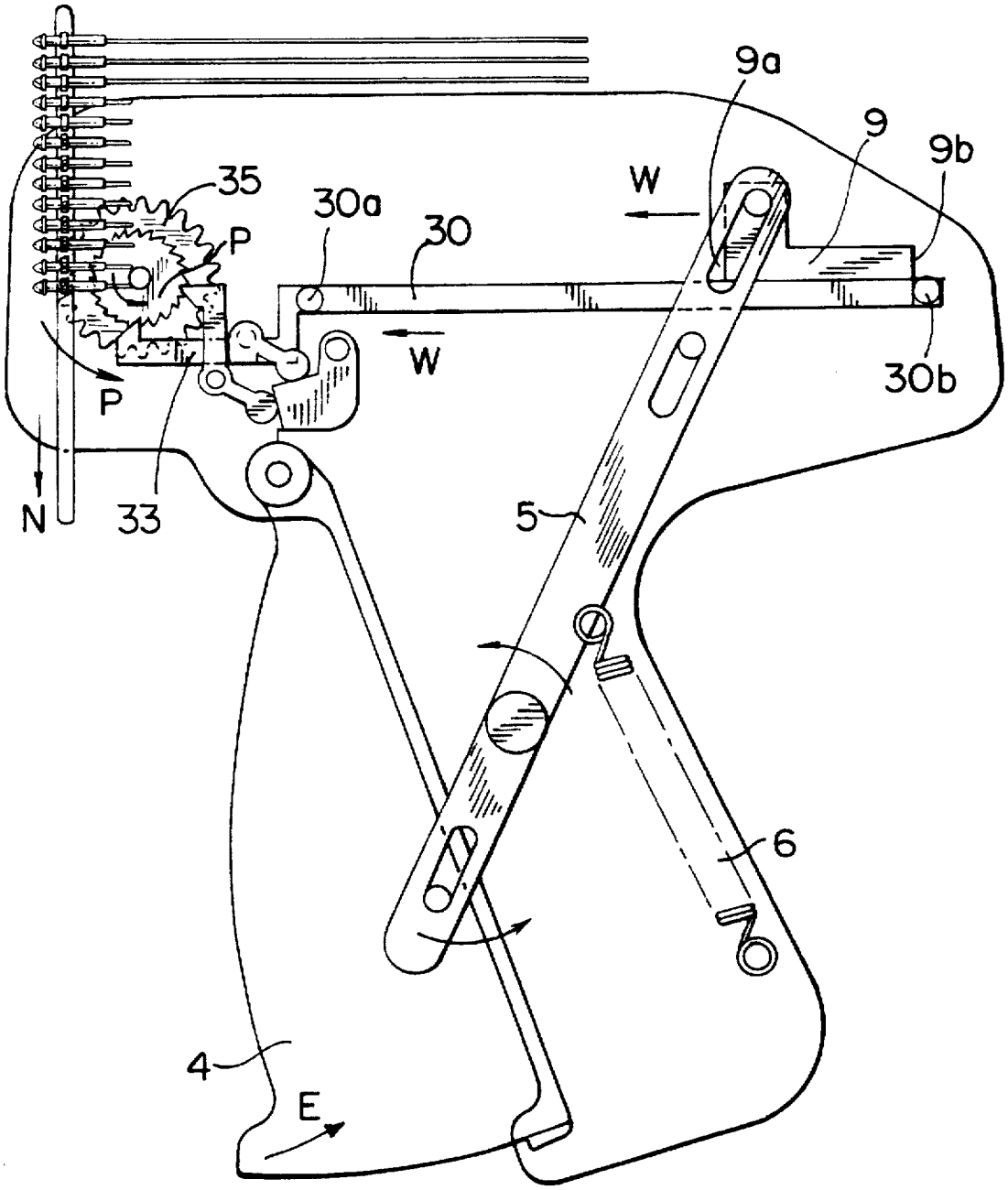
FIG. 25 is a side elevational view of the loop pin attaching device of FIG. 1 and depicting the ratcheting of another loop pin into position.
Figure 26:
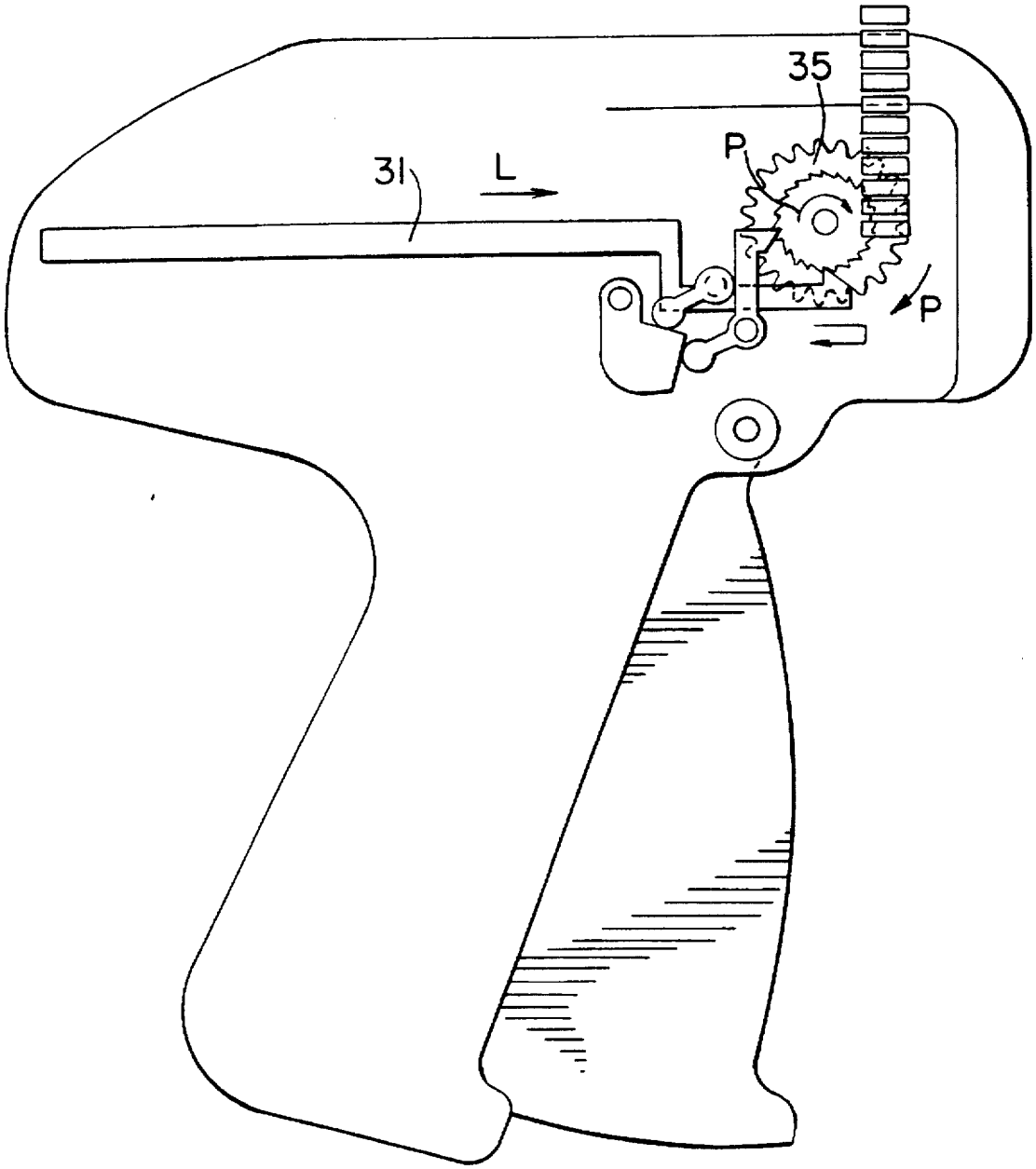
FIG. 26 is a side elevational view of the loop pin attaching device of FIG. 1, as viewed from the opposite side as FIG. 25 and depicting the ratcheting of another loop pin into position.

When drive lever 4 is moved in the direction ,apposite from the direction indicated by arrow E in FIG. 25, piston member 9 moves opposite the direction indicated by arrow W. Face 9b of piston member 9 engages stepped extending portion 30b, thereby urging first slider portion 30 opposite the direction indicated by arrow W. Similarly, stepped extending portion 31b, is engaged by pushing protruding piece 23a of belt 23, thereby urging first slider portion 30 opposite the direction indicated by arrow L in FIG. 22 and FIG. 26, thus returning each of sliding rails to its original state. As each of sliding rails 30 and 31 returns to its original state, stopper 36 is re-engaged with ratchet 34 through the biasing force of wound spring 42, thereby allowing the apparatus to remain in a fixed state and to stop ratchet 34 from any further unwanted motion, and thereby completing the positioning of the next loop pin to be used by the gun. Thus, the movement of slider portions 30 and in a first direction and then in a second direction allows feed gear to advance one ratchet in the direction indicated by arrow P in FIG. 25. By this rotation, feed gear 35 advances one loop pin per ratchet into position to be attached by the loop pin attaching device gun.

Release member 40 is maintained in sliding contact with the rear ends of operating elements 38 and 36a. Stopper 36 protrudes out of casing 1. If stopper 36 is moved (obliquely right upward in FIG. 1) by operation of a button or the like connected to release member 40, stopper 36 is released from its fixed state thereby releasing ratchet 34, and it then becomes possible to take continuous body 500 out of the device.

Additionally, in an alternative embodiment, a rack-shaped ratchet mechanism may be attached to the inner bottom section of the drive lever 4. Thus, even if operation of drive lever 4 is stopped mid-way in its activated position, it becomes possible to maintain drive lever 4 in its intermediate state, and thereafter easily continue the operation when required.

In an alternative embodiment, as shown in FIGS. 7, 8, 10 and 20, receiving portion 300 may alternatively be provided with an aperture 34' in collar 32' generally in the shape of a greek letter phi (Φ). In this case, two rounded resilient inner surfaces 36' of aperture 34' form the anchoring portions of the socket and perform the same locking function as anchoring protrusions 36 shown in FIG. 1. However, the reliability of the locking engagement of inserting part 20 within socket 30 may be enhanced by the use of the phi-shaped aperture 34' because the rounded anchoring portions 36' engage a larger portion of the circumference of both stepped portion 26 and collar 22 inserting part 20 than do anchoring protrusions 36, and therefore anchoring portions 36' provide enhanced resistance to an attempt to remove inserting part 20 from socket 30 by force.

The loop pin attaching device for tag hanging constructed in accordance with the invention provides an improved operational efficiency. The required operational time is greatly reduced. In addition, since a continuous body of loop pins can be used in the device, rather than individual pins, efficiency is further improved. Since all of the operations are performed in a mechanical manner, the occurrence of problems is reduced, and the burden on an operator is reduced. The improved loop pins enhance the operation of this loop pin attaching device.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A loop pin attaching device for tag hanging, comprising:

a drive lever, said drive lever selectively moveable between a first, unactivated position and a second, activated position;

a link rotatably connected with said drive lever, said link connected to said drive lever at a first end of said link, said link selectively moveable between a first, unactivated position and a second, activated position;

a piston member connected to a second end of said link, said piston member being selectively moveable between a first, unactivated position and a second, activated position;

a pressing body fixed to a front face of said piston member, said pressing body being formed with a pipe shape;

an insertion guide, said insertion guide dimensioned to allow said pressing body to slide therethrough when said piston member is moved from said first position to said second position and to receive an insertion portion of a loop pin;

a rack gear rotatably fixed to said link adjacent said second end of said link;

a gear group which meshingly engages said rack gear, said gear group being formed of at least a first, smaller diameter gear and a second, larger diameter gear, said rack gear engaging said smaller diameter gear;

a belt which engagingly meshes with said larger diameter gear of said gear group, said belt adapted to move a receiving portion of a loop pin; and a reception guide dimensioned to guide a receiving portion of a loop pin when said guide lever is moved from said first position to said second position, wherein said insertion guide and said receiving guide are adapted to deliver an insertion portion and a receiving portion, respectively, of a loop pin to a common location to form a loop.

2. The loop pin attaching device of claim 1, wherein said drive lever may be maintained in its second, activated position.

3. The loop pin attaching device of claim 1, wherein said insertion guide is formed with a slit in a portion thereof dimensioned to receive said insertion portion of said loop pin.

4. The loop pin attaching device of claim 3, wherein said pressing body is formed with a slit formed in the end thereof opposite said piston member.

5. The loop pin attaching device of claim 1, wherein said gear group provides a gear ratio advantage to said belt as compared with said gear rack so that said belt moves faster than said gear rack when said drive lever is moved from said first, unactivated position to said second, activated position.

6. The loop pin attaching device of claim 1, wherein said reception guide is formed with a J-shape, said reception guide having an outer edge and an inner edge.

7. The loop pin attaching device of claim 6, further comprising a groove formed on the inner edge of said reception guide, said groove extending the entire length thereof.

8. The loop pin attaching device of claim 7, further comprising a notch formed on the inner edge of said reception guide at an end of said groove, said notch allowing for removal of a receiving portion of a loop pin after it has received an insertion portion of a loop pin.

9. The loop pin attaching device of claim 1, further comprising a biasing spring fixed to said link, said biasing spring biasing said link, said drive lever and said piston member in said first, unactivated position.

10. The loop pin attaching device of claim 1, further comprising a plurality of loop pins;

at least one runner, said plurality of loop pins being disposed in a predetermined direction and substantially coplanar with one another to form a continuous sheet, and each of said fasteners being attached to said at least one runner, said at least one runner being spaced from said plane;

a plurality of flanges extending from said at least one runner, and wherein each of said plurality of fasteners is attached to said at least one runner by at least one flange, said flange spacing said at least one runner from said plurality of loop pins;

a first sliding rail coupled to said piston member, said first sliding rail being formed with a hook formed at one end thereof;

a second sliding rail coupled to said belt, said second sliding rail being formed with a hook formed at one end thereof;

a hook fixed to said belt;

a ratchet, said ratchet dimensioned and positioned to be engaged by said hook formed on said first sliding rail and by said hook formed on said second sliding rail; and a feeding gear which engages said at least one flange and provides an individual loop pin to said loop pin attaching device.

11. The loop pin attaching device of claim 10, wherein the movement of said drive lever from said first position to said second position and back to said first position causes said loop pin sheet to advance through said loop pin attaching device.

12. The loop pin attaching device of claim 11, wherein said feeding gear contacts a loop pin of said sheet to advance said loop pin.

13. The loop pin attaching device of claim 12, further comprising:

a stopper hook selectively engaging said ratchet; and a release member for releasing said stopper whereby when said stopper is released, said and thus it is made possible to remove the loop pin sheet from said loop pin attaching device.

14. The loop pin attaching device of claim 13, wherein said release member may be operated from outside said loop pin attaching device.

15. The loop pin attaching device of claim 10, further comprising:

a first extending portion protruding from said first sliding rail, said first extending portion severing one of said loop pins from said runner and said flange upon operation of said drive lever.

* * * * *